US010426301B2

(12) United States Patent
Sumpton et al.

(10) Patent No.: US 10,426,301 B2
(45) Date of Patent: Oct. 1, 2019

(54) SINK ACCESS DEVICE

(71) Applicants: Joi Sumpton, Dunwoody, GA (US); Paul Sumpton, Dunwoody, GA (US)

(72) Inventors: Joi Sumpton, Dunwoody, GA (US); Paul Sumpton, Dunwoody, GA (US)

( * ) Notice: Subject to any disclaimer, the term of this patent is extended or adjusted under 35 U.S.C. 154(b) by 0 days.

(21) Appl. No.: 15/703,912

(22) Filed: Sep. 13, 2017

(65) Prior Publication Data

US 2019/0075983 A1 Mar. 14, 2019

(51) Int. Cl.
*A47K 17/02* (2006.01)
*A47K 1/14* (2006.01)

(52) U.S. Cl.
CPC ..... *A47K 17/02* (2013.01); *A47K 1/14* (2013.01)

(58) Field of Classification Search
CPC ..... A47K 2003/367
USPC ..... 4/610
See application file for complete search history.

(56) References Cited

U.S. PATENT DOCUMENTS 3,271,075 A * 9/1966 Good ..... A47C 16/02 108/129
4,462,636 A * 7/1984 Markson ..... A47C 16/02 108/128
5,218,912 A * 6/1993 Buske ..... A47B 3/08 108/14
6,568,506 B1 * 5/2003 Donnalley ..... A47C 12/02 108/129
D567,395 S * 4/2008 Bishop ..... A47C 12/02 D25/65
D615,667 S * 5/2010 Dunn ..... A47C 12/02 D25/65
8,403,419 B2 * 3/2013 Damrow ..... A47C 16/02 182/33
8,528,489 B2 * 9/2013 Roy ..... A47B 3/08 108/125
8,661,991 B2 * 3/2014 Eveleth ..... A47B 3/08 108/115
D745,286 S * 12/2015 Thibault ..... A47C 12/02 D6/349
D787,845 S * 5/2017 Edwards ..... A47C 12/02 D6/353
2002/0096918 A1 * 7/2002 Russomanno ..... E06C 1/005 297/217.1
2012/0234630 A1 * 9/2012 Havens ..... A47C 12/00 182/223

* cited by examiner

*Primary Examiner* — Lori L Baker

(57) ABSTRACT

A method of providing access to a sink by a diminutive person in a public restroom and an individual in a wheelchair. The method comprising providing a sink positioned above the floor and also includes providing an unobstructed frontal approach zone of at least thirty inches in width in front of the sink. A sink access device is provided having a first upright position positioned outside the unobstructed frontal approach zone. In this position, an individual in a wheelchair has access to the sink. The sink access device may be deployed into a horizontal position into the frontal approach zone providing access to the sink for a diminutive person such as a child. The sink access device includes a bias for biasing the sink access device in the first natural vertical position.

7 Claims, 6 Drawing Sheets

SINK ACCESS DEVICE

TECHNICAL FIELD

This invention relates generally to a sink access device and more particularly to a sink access device for a public restroom which provides access to a sink by diminutive individuals and wheelchair occupants.

BACKGROUND OF THE INVENTION

State and local ordinances dictate the necessity for public restrooms in certain establishments. For instance, under some regulations, restaurants need a single water closet per seventy-five male and female patrons but only one lavatory for two hundred patrons. For larger arenas, one water closet per one hundred and twenty males and sixty females is required while only requiring one lavatory per two hundred males and one hundred and fifty females. For large passenger terminals, one water closet per five hundred individuals and one lavatory per seven hundred individuals is required.

While the number of public restrooms is mandated, the actual restroom designs are not. The flux of the inconsistencies of restrooms has prompted, among other things, the formation of the American Restroom Association, which discusses various aspects of restrooms at www.American-restroom.org. The mission statement for the American Restroom Association includes the advocation for the availability of clean, safe, well-designed public restrooms which includes restroom design and technology, restroom availability, pertinent legislation and regulations, and increasing research related to the problems faced by people who hesitate to travel or who avoid activities that put them out of range of proper toilet facilities. With a few exceptions, states adopt either the International Plumbing Code (IPC), the Uniform Plumbing Code (UPC) or the National Standard Plumbing Code (NSPC). While these codes typically are concerned with identifying issues regarding the number of restrooms and lavatories which must be present depending upon accessibility and the size of the public establishment, these codes are deficient in identifying specific requirements to standardization of rest rooms. For instance, while there is a trend for hands-free operation of toilets, lavatories and the like, these are merely incorporated into restrooms at the discretion of the proprietor of the public facility and are not mandated by any legislation. Accordingly, while restrooms are required to meet certain standards so that they can be utilized by everyone, they are not necessarily designed for everyone. In fact, until recently, handicapped individuals experienced great hardship in utilizing public restrooms until legislation to eliminate these hardships was put into place by the passage of the Americans with Disabilities Act ("ADA"). Accordingly, since the utilization of public restrooms is a common occurrence, their designs should include access for everyone. For the purposes of this patent application, "restroom" is defined as a room equipped with toilets and lavatories for public use.

In addition to the adequate presence of restrooms, the overall construction and condition of restrooms is also important to the public. A survey conducted by the International Facility Management Association, www.ifma.org, indicated that besides a public building's front entrance, its restrooms have the greatest potential to negatively impact a visitor's impression of a facility. Also, durability, cleanliness and ADA compliance were highly regarded characteristics of restrooms. Of the respondents to the survey, nearly three-quarters believed that their restrooms were the most frequently visited common area of the building. Key findings from the survey indicated that issues regarding the restrooms were as frequent as other prime issues such as parking and temperature. In particular, customers were most concerned with restroom cleanliness and indicated hands-free sensor technology is the most popular design trend. Accordingly, the experience which the public has with a particular establishment's restroom will greatly affect that individual's perception of that establishment.

The interrelationship between the public and restrooms is so intertwined that not only is the location of restrooms important but also their accessibility, interactivity and safety. For instance, at a meeting at the School of Architecture and Planning at the University of Buffalo regarding utilization of public amenities, certain key attributes for restrooms was discussed. Such guidelines regarding the design of restrooms included the physical design, such as the floor surfaces draining and drying quickly; the provision of the automatic flush plumbing and changing tables for babies; hooks for coats at or below 48 inches, and other ergonomically friendly features.

However, with all of the attention placed on restrooms and their "friendliness" to the public, a major problem with restrooms currently exists. Namely, lavatories are too high for children, toddlers and diminutive persons to utilize. This is especially a problem because many lavatories have installed infrared devices to trigger the faucet to turn on. Hence, while parents go to public places with their children such as museums, aquariums, zoos, and restaurants, the lavatories and sinks at these public restrooms are too high for the child to use without assistance from a parent. Accordingly, a parent has to pick up a toddler and hold them prone over a sink countertop to enable the toddler to wash its hands. Inevitably, the toddler gets its clothing wet due to the water left on the countertop from previous usage by an adult. To perform this maneuver, the parent typically has to place a diaper bag or other item which he is typically carrying onto the lavatory floor, pick up the toddler, and then place the toddler back down. As toddlers mature, their weight can approach forty pounds and more, but they are still too short to utilize the lavatory. Such toddler weight is too heavy for some parents, and in some cases, the parent may injure himself picking up and orienting the toddler over the sink.

To alleviate the problem associated with not enabling sink access for toddlers and diminutive persons the inventors of this application have previously been awarded three patents for a sink access device which enables toddlers and diminutive persons to access a sink. The patents are U.S. Pat. Nos. 8,037,557; 7,861,332; 7,716,757 for a sink access device. This innovative invention was recognized and discussed in the USPTO's own publication "Inventor's Eye" in January 2011 when the '332 patent was issued. An additional recognition of the unique novelty of the invention in the '557; '332; and '757 patents and need in the marketplace was identified by the product being awarded best new product by the International Association of Amusement Parks in 2011. While the sink access device associated with these patents are suitable for their intended purpose, they are not suitable for single sink restrooms. Accordingly, an improved design is necessary.

SUMMARY OF THE INVENTION

One embodiment includes a public restroom having a wall and a floor which includes a sink positioned above the floor of the restroom. The sink is of a predetermined height and width having a first side edge and a second side edge associated with the sink front defining a sink front profile. The sink has a forward approach zone thirty inches in width defined forward of the sink front profile. The forward approach zone is unobstructed providing access to the sink by a wheelchair occupant. A sink access device has a step support mount and a step pivotally mounted to the step support mount. The step has a first upright position wherein the step is in a first position which is vertical and a second position wherein the step is in a second position which is horizontal providing a platform for a diminutive person to step onto for accessing the sink. The step being positioned in front of and beside the sink front profile of the sink when the step is in the first upright position; and the step being in front of and offset from the sink front profile when in the second horizontal position providing access to the sink for a diminutive person; and the step support mount being positioned outside the forward approach zone.

In an additional embodiment, a sink access device is provided for a restroom having a sink positioned above the floor of the restroom. The sink is of a predetermined height and width having a first side edge and a second side edge associated with the sink front defining a sink front profile. The sink access device includes a step support mount and a step pivotally mounted to the step support mount. The step having a first upright position wherein the step is in a first position which is vertical and a second position wherein the step is in a second position which is horizontal providing a platform for a diminutive person to step onto for accessing the sink. The step being positioned in front of and beside the sink front profile of the sink when the step is in the first upright position; and the step being in front of and offset from the sink front profile when in the second horizontal position providing access to the sink for a diminutive person.

In an additional embodiment, a method for providing access to a sink for a diminutive person and wheelchair bound occupant is provided. The method includes providing a sink of a predetermined height and width having a first side edge and a second side edge associated with the sink front defining a sink front profile. A forward approach zone thirty inches in width is defined forward of the sink front profile which is clear of obstacles. The method further includes providing a sink access device having a step support mount and a step pivotally mounted to the step support mount. The step having a first upright position wherein the step is in a first position which is vertical and a second position wherein the step is in a second position which is horizontal providing a platform for a diminutive person to step onto for accessing the sink. The method further includes mounting the sink access device outside of the forward approach zone permitting unrestricted access to the sink when the sink access device is not deployed in the second position which is horizontal.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Embodiments of the present disclosure includes a sink access device which provides access to a sink for a diminutive person such as a child or smaller adult while providing access to the sink for a handicapped individual and also providing unimpeded access by an adult or non-handicapped individual.

Figure 1A:
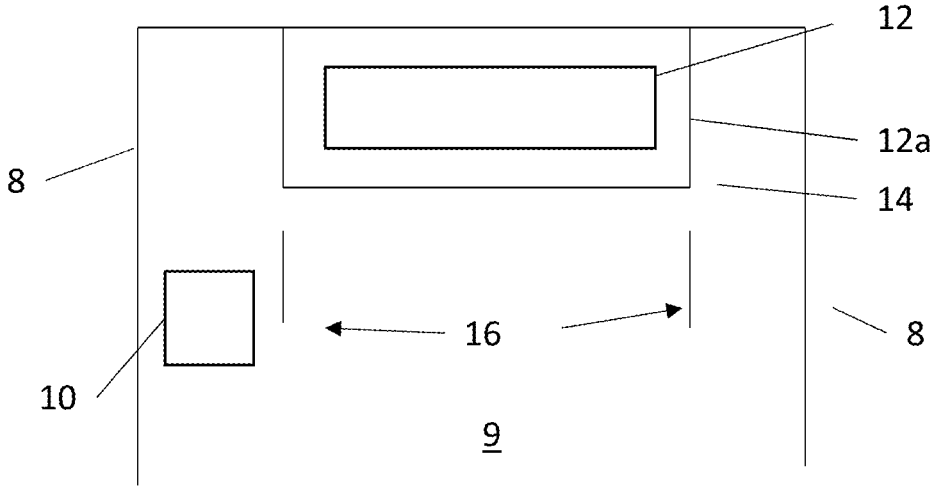
FIG. 1*a* illustrates a downward view of a restroom configuration with a sink access device in a non-deployed position according to the present invention.

As illustrated in FIG. 1*a*, a restroom A preferably includes walls 8, floor 9 and a sink access device 10 as shown in an undeployed upright position. The restroom further includes a single sink 12. Single sink 12 is generally contained within a cabinet or vanity 12*a*. For purposes of this disclosure, the term "sink" includes a single sink and related equipment such as a cabinet. Sink 12 preferably includes a front and a back, the sink is of a predetermined height and width defining a front profile 14. An unobstructed frontal approach zone 16 is located before front profile 14. Unobstructed frontal approach zone 16 is at least thirty inches in width providing unobstructed access to sink 12. In the undeployed position, sink access device does not enter into the unobstructed frontal approach thereby leaving unobstructed frontal approach vacant for access to the sink by an individual in a wheelchair.

Figure 1B:
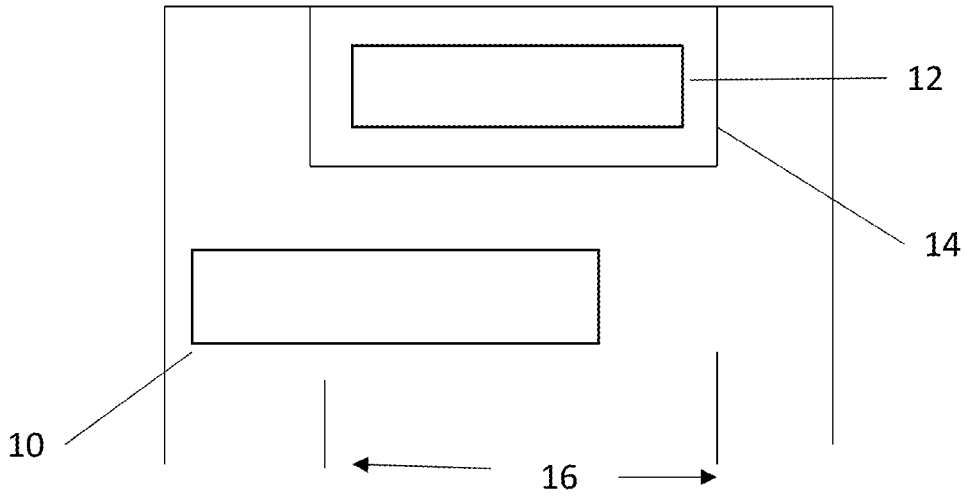
FIG. 1*b* illustrates a downward front view of a restroom configuration with a sink access device in a deployed position according to the present invention.

FIG. 1*b* illustrates a downward front view of sink access device 10 in a deployed position. As shown, sink access device 10 is offset from the front plane of the sink and also offset to a side of the sink. In the deployed position, sink access device enters into the unobstructed frontal approach zone 16 providing access to the sink for an individual.

Figure 2A:
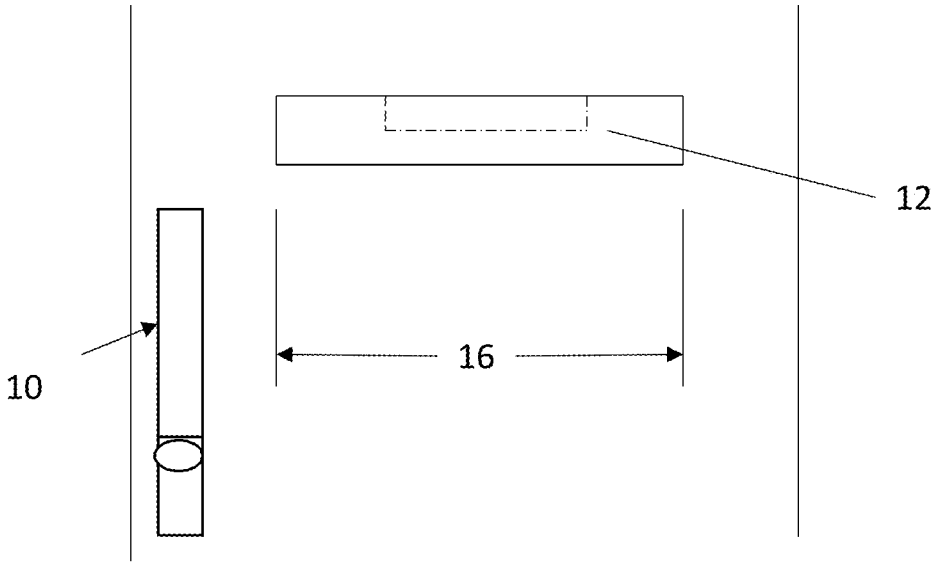
FIG. 2*a* illustrates a front view of a restroom configuration with a sink access device in a non-deployed position according to the present invention.
Figure 2B:
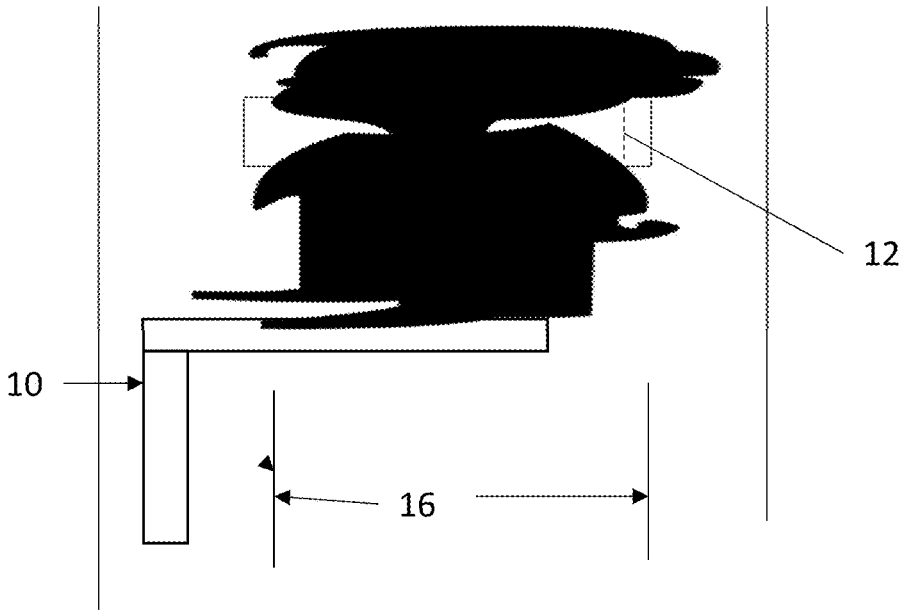
FIG. 2*b* illustrates a front view of a restroom configuration with a sink access device in a deployed position according to the present invention.

FIG. 2*a* illustrates a restroom having a sink access device from a frontal view. Sink access device 10 is deployed outside the unobstructed frontal approach zone 16 leaving unobstructed frontal approach zone 16 unobstructed when in an undeployed position. As shown in FIG. 2*b*, when sink access device 10 is in a deployed position, the sink access device enters into the unobstructed frontal approach zone 16 providing access to sink 12 by an individual.

Figure 3A:
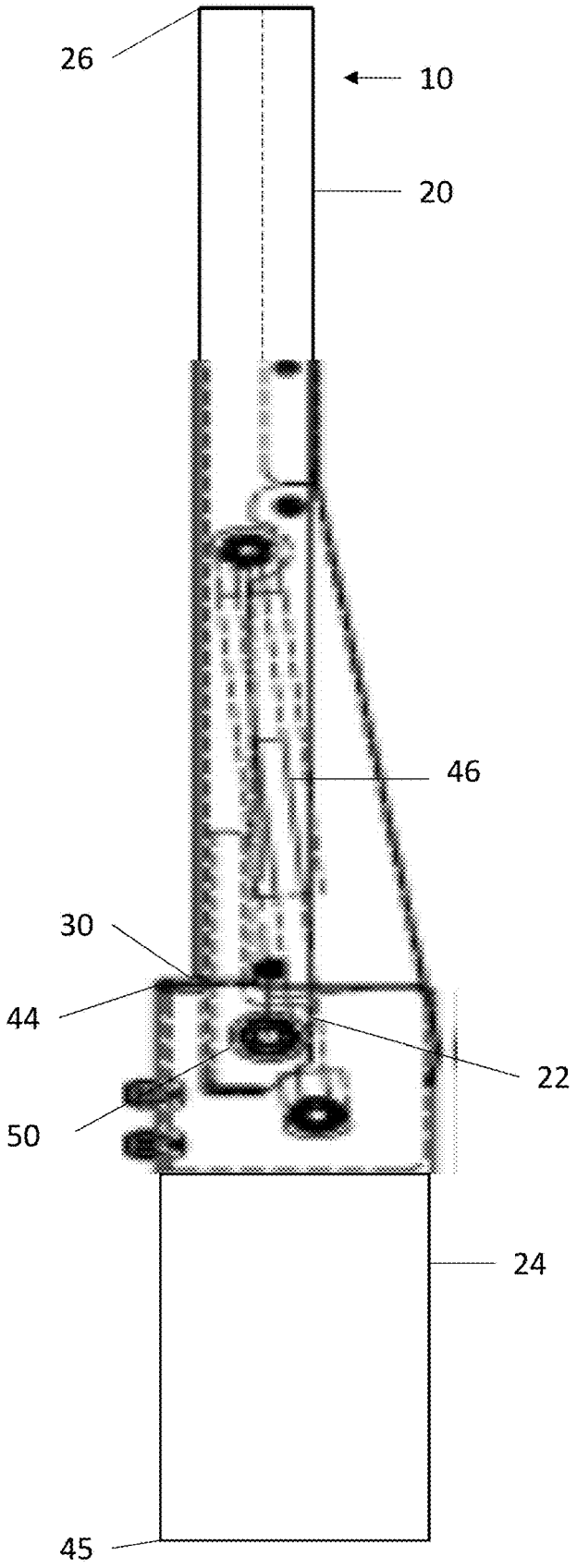
FIG. 3*a* illustrates a cross sectional view of the sink access device in a non-deployed position according to the present invention.
Figure 3B:
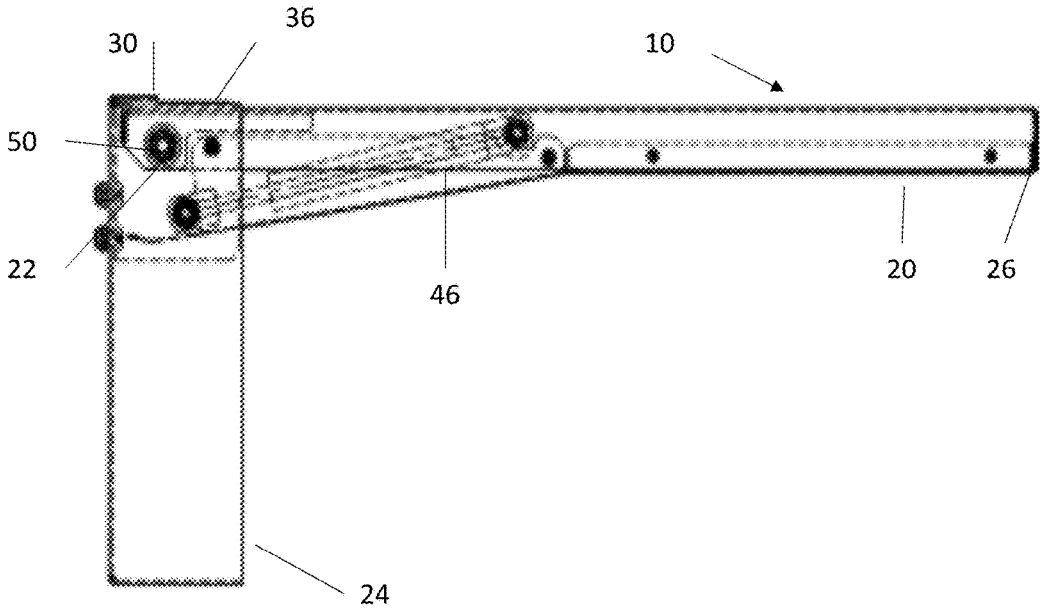
FIG. 3*b* illustrates a cross sectional view of the sink access device in a deployed position according to the present invention.

FIGS. 3*a* and 3*b* illustrate sink access device 10 according to a preferred embodiment of the invention. Sink access device 10 includes a step 20 having a step base 22 pivotally mounted to a step support mount 24. The step, as shown in FIG. 3*a* has a first upright position wherein the step is in a first position which is vertical and as shown in FIG. 3*b*, a second position wherein the step is in a horizontal position providing a platform for a diminutive person to step onto.

The step includes a step front edge 26 disposed opposite of the step base 22 along the length of the step. The step front edge remaining in front of the vertical front plane of the sink when in said second position and offset from the sink for providing access to the sink for a diminutive person.

The sink access device may include a travel stop 30 wherein when the step pivots from the first upright position to the second position. The travel stop stops the step in the horizontal second position. The travel stop may include a lip 36 carried by the step support which overhangs step base 22 whereby step base 22 engages lip 36 when pivoting from the vertical to horizontal position when deployed. Travel stop 30 may also include other devices for limiting the horizontal deployment of step 20 such as a leg which may engage the floor.

The sink access device may include a step support mount 24 which includes a first leg 40 and a second leg 42 offset from the first leg, each leg having a general length including a leg top 44 and a leg bottom 45, a step support top 48 which maybe lip 36 interconnects the leg tops. The step support top having a predetermined width, and the step pivotally mounted to each of said legs.

Step support mount 24 may consist of a single leg such as a post wherein the step base 22 is pivotally mounted to the post and transitions from a vertical to a horizontal position until the deployment into the horizontal position is stopped.

The sink access device preferably includes a bias 46 for urging the step from the second position which is horizontal to the first position which is vertical when the step is not being utilized. In a preferred embodiment, bias 46 is a gas spring.

As shown in FIG. 3*a*, step 20 is biased by bias 46 to be maintained in a natural upright vertical position. This is the first position and natural position of the step. Step 20 is pivotally mounted to step mount 24 at pivot 50 located at an upper region of step mount 24. In this position, the horizontal footprint of the sink access device is defined by the width of step mount 24 at the leg bottom 45. In the preferred embodiment, the horizontal footprint is not greater than five inches.

As shown in FIG. 3*b*, when in the second horizontal deployed position, step 20 pivots around pivot 50 until it stops in a horizontal planar position for providing a stepping surface for a diminutive person. When the weight of the individual is removed from the step, the bias 46 urge the step to its initial vertical position.

Figure 4A:
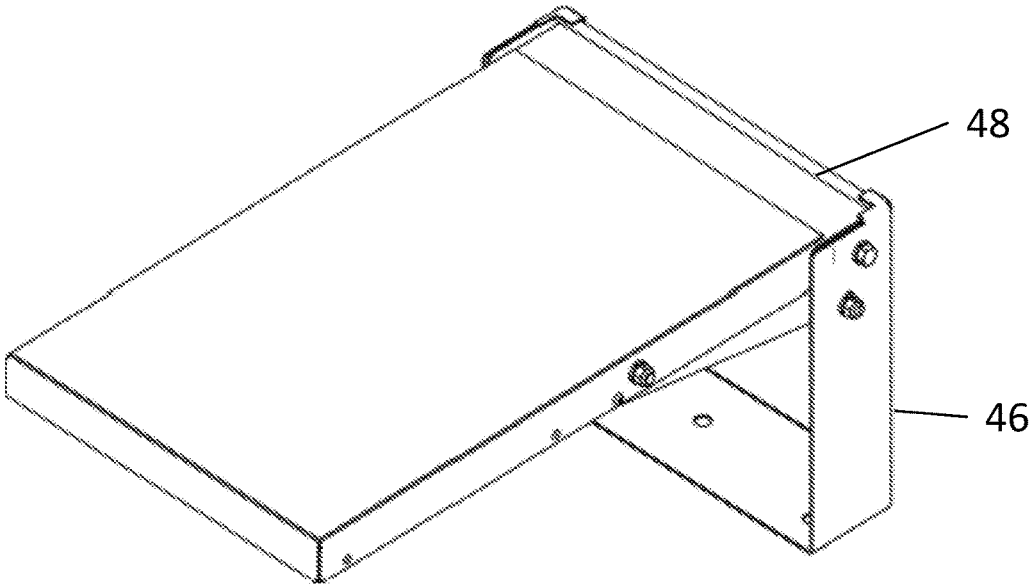
FIGS. 4*a* and 4*b* illustrate a perspective view of the sink access device in a deployed position according to the present invention.
Figure 4B:
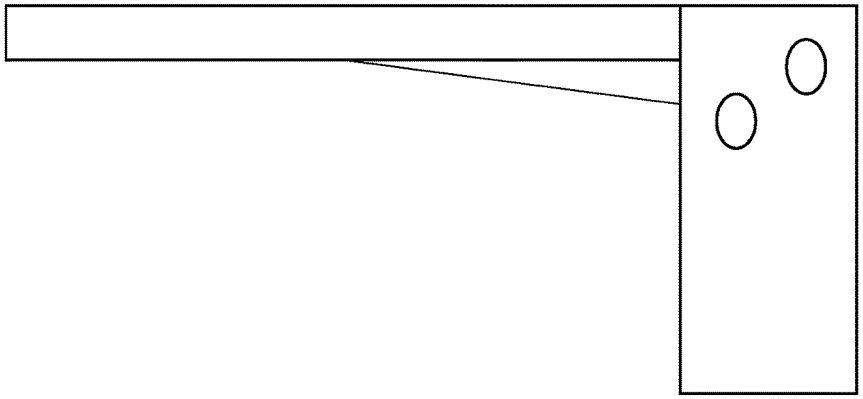

FIGS. 4*a* and 4*b* illustrate the sink access device in a deployed position. Step 20 is of a general width sufficient to provide a stepping platform for a diminutive person to access a sink. In general the step is approximately twenty-five inches in length and approximately six to seven inches in height. In the preferred embodiment, the step support mount has a footprint width not greater than five inches and is capable of supporting a diminutive person. For example, the step support mount may support from thirty pounds to two hundred pounds of static weight while interacting with the floor in a space no greater than five inches in width outside of the frontal approach zone. In the preferred embodiment, the footprint is no greater than three inches.

Figure 5:
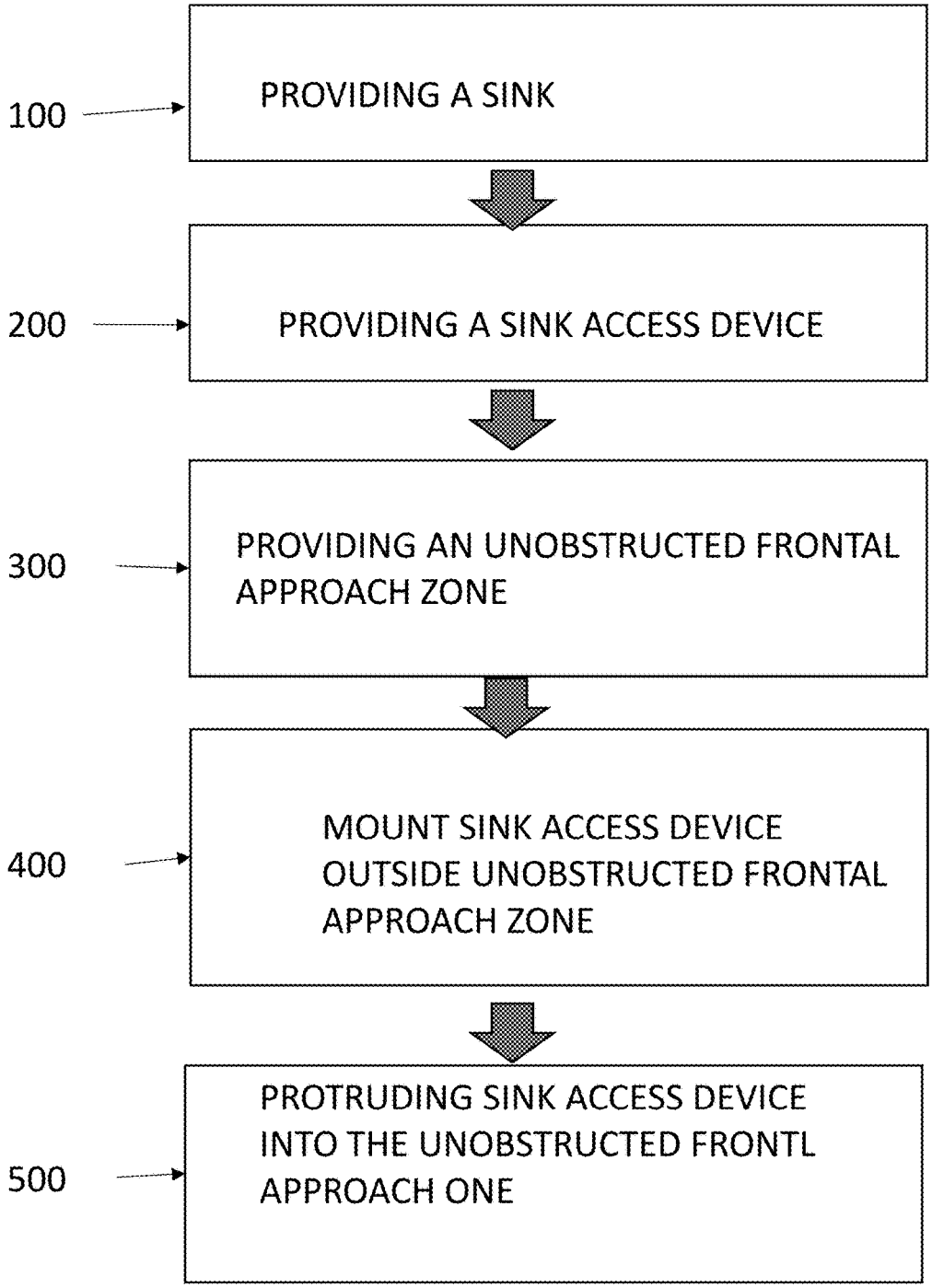
FIG. 5 illustrates a method of providing a sink access device according to the present invention.

FIG. 5 illustrates a method of providing sink access to a diminutive person while also providing sink access for a handicapped individual utilizing a wheelchair. As shown in FIG. 5, the method includes step 100 providing a sink. Typically this is a single sink configuration. At step 200, a sink access device is provided. At step 300, an unobstructed frontal approach zone to the sink is provided. This unobstructed frontal approach zone consists of at least thirty inches of unimpeded access to the sink. At step 400, the sink access device is mounted outside the unobstructed frontal approach zone. At step 500, the sink access device is allowed to protrude into the unobstructed frontal approach zone to provide a step enabling a diminutive person to access a sink.

In operation, the sink access device of the present invention provides for a unique solution to accessing a sink by three separate groups of individuals. As noted in the background, accessing a sink by a child or diminutive person is an arduous task. The present invention provides a solution by providing a sink access device which may be deployed in a horizontal position which enables the child or diminutive person to step onto and access the sink. When not deployed, the sink access device includes a bias for automatically transferring the step into a vertical position. When in the vertical position, the sink access device is positioned outside a frontal approach zone located in front of the sink. The frontal approach zone provides at least thirty inches of unimpeded access to the sink for an individual in a wheelchair. Also, with the sink access device deployed it the natural vertical position, access to the sink is also unimpeded for an adult who is not handicapped. In this public restroom construction, the single sink is accessible by these at least three groups of individuals.

We claim:

1. A public restroom having a wall and a floor comprising:

a sink positioned above the floor of the restroom, said sink having a front and a back, said sink of a predetermined height and width defining a front profile defining a front vertical plane having a first side edge and a second side edge associated with said sink front;

a frontal approach zone positioned in front of said front vertical plane of said sink, said frontal approach zone being at least thirty inches in width providing unimpeded access to said front profile of said sink;

a sink access device comprising:

a step support mount mounted to either said floor or a side wall;

a step having a step base pivotally mounted to said step support mount, said step having a first upright position wherein said step is in a first position which is vertical and a second position wherein said step is in a horizontal position providing a platform for a diminutive person to step onto to access said sink;

said step support mount being securely mounted in front of said front vertical plane of said sink outside said frontal approach zone;

said step being securely positioned outside said frontal approach zone in front of and beside said front vertical plane of said sink when said step is in said first upright position; and said step including a step front edge disposed opposite of said step base along the length of said step, said step front edge disposed within said frontal approach zone in front of said vertical front plane when in said second position and offset from said sink for providing access to the sink for a diminutive person.

2. The sink access device of claim 1 further including a travel stop wherein when said step pivots from said first upright position to said second position said travel stop stops said step in said horizontal second position.

3. The sink access device of claim 1 wherein said step support mount includes a first leg and a second leg offset from said first leg, each leg having a general length including a leg top and a leg bottom, a step support top interconnecting said leg tops, said step support top having a predetermined width, said step pivotally mounted to each of said legs.

4. The sink access device of claim 1 wherein said step includes a rear portion which engages the step support stop when transitioning from said first position which his vertical to the second position which is horizontal.

5. The sink access device of claim 1 including a bias for urging said step from said second position which is horizontal to the first position which is vertical when the step is not being utilized.

6. The sink access device of claim 1 wherein said step support mount has a footprint width no greater than five inches.

7. The sink access device of claim 1 wherein said step support mount has a footprint width no greater than three inches.

* * * * *